US006900786B1

(12) United States Patent
Johnson et al.

(10) Patent No.: US 6,900,786 B1
(45) Date of Patent: May 31, 2005

(54) DISPLAY DEVICE

(75) Inventors: Mark T. Johnson, Eindhoven (NL); Sjoerd Stallinga, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 716 days.

(21) Appl. No.: 09/262,102

(22) Filed: Mar. 4, 1999

(30) Foreign Application Priority Data

Mar. 4, 1998 (EP) ..... 98200688

(51) Int. Cl.[7] ..... G09G 3/36
(52) U.S. Cl. ..... 345/87; 345/98; 345/211
(58) Field of Search ..... 345/92, 90, 87, 345/88, 89, 98, 99, 100, 94, 95, 690, 211

(56) References Cited

U.S. PATENT DOCUMENTS 5,936,686 A * 8/1999 Okumura et al. ..... 345/92
5,940,055 A * 8/1999 Lee ..... 345/92
5,952,991 A * 9/1999 Akiyma ..... 345/92

FOREIGN PATENT DOCUMENTS

EP 0514034 A2 11/1992 ..... G09G/3/36
JP 3-126072 * 5/1991
JP 4-7627 * 1/1992

OTHER PUBLICATIONS

"A Wide Viewing Angle TFT–LCD with a Bias Voltage Controlled Method and a Compensation Method of Shading", AM–LCD '96/IDW '96, pp. 145–148.

* cited by examiner

*Primary Examiner*—Xiao Wu

(57) ABSTRACT

A display device, operable both for private view and more viewers. Switching between the two functions is obtained by switching between different voltage ranges, for example, normal voltage swing (curve 1) and shifted voltage swing (curve 4).

9 Claims, 2 Drawing Sheets

DISPLAY DEVICE

BACKGROUND OF THE INVENTION

The invention relates to a display device comprising a matrix of pixels, in which each pixel is coupled to a row electrode and a column electrode, control means comprising first drive means for applying a selection signal to the row electrodes and second drive means for applying a data signal to the column electrodes.

Display devices of this type are used in, for example, monitors, laptop computers, etc. A display device may be a transmissive or a reflective device.

Display devices of the type described in the opening paragraph are generally known and are increasingly used, inter alia, because the viewing angle dependence (loss of contrast and grey scale inversion when viewing at a large angle with respect to the normal) has become considerably less important in the last few years. However, this has also some drawbacks. Increasing use is being made, notably of laptop computers in public establishments and trains. On the one hand, it is troublesome and sometimes undesirable when a neighbor or fellow traveler also watches the screen, particularly when confidential information is being displayed. On the other hand, it is often desirable to show the information via the same display device to a larger number of people.

OBJECTS AND SUMMARY OF THE INVENTION

It is, inter alia, an object of the invention to provide a display device of the type described above in which the above-mentioned drawbacks are at least partly eliminated.

To this end, a display device according to the invention is characterized in that the control means comprise means for adjusting different voltage ranges across a pixel during different drive modes of the display device.

By rendering the voltage range adjustable, the display device can be adjusted in such a way that the pixels are driven in a voltage range for which the viewing angle dependence (notably in the horizontal direction, i.e. in a 6 o'clock or 12 o'clock display) is such that the picture is observed only at a very small angle with respect to the normal on the screen. This is notably achieved when the different voltage ranges have a different average absolute value. The voltage range for different pixels is preferably identical within the different voltage ranges.

In screens based on (twisted) nematic liquid crystalline material, the visibility at an angle (at the same width of the voltage range) decreases when the average absolute value of the voltage across the pixel increases.

At a smaller width of the voltage range and the same average absolute value of the voltage, the visibility at an angle will decrease but less than in the previous case; the contrast for perpendicular passage of light does decrease considerably.

If necessary, the measure described may be applied to a part of a picture to be displayed.

At a smaller width of the voltage range and a smaller average absolute value of the voltage, the visibility at an angle increases.

Either discrete switching or a continuous change-over takes place between the different voltage ranges.

A voltage range may be characterized by voltages associated with two extreme states, for example the white and the black state for both voltage ranges. Preferably one of the two extreme states being preferably is common for different voltage ranges.

The display device may be a passive device (no switching elements) or an active device (provided with switching elements such as two or three-poles, or a plasma-addressed screen).

The adjustment of the voltage ranges is also dependent on the drive mode. For an active display device based on thin-film transistors, each pixel is coupled to the row or column electrodes via a switching element and is provided with at least one counter electrode, and the control means comprise means for applying different voltages for the different voltage ranges to the counter electrode. The counter electrode may be provided on the same substrate or on a second substrate.

If capacitive coupling is used in this case, the picture electrode is capacitively coupled to a further electrode, and the display device comprises drive means for applying a selection signal to the row electrodes during a selection period and a bias signal to the row electrode or the further electrode, and the control means comprise means for applying different voltages for the different voltage ranges to the row electrode or the further electrode.

Where the selection signal is referred to in this application, the signal is meant which causes the switching element to conduct (generally, the actual gate pulse of a TFT transistor). Where a (gate-)bias signal or (gate-)bias voltage is referred to, a bias signal or bias voltage as described in, for example, "A Wide Viewing Angle TFT-LCD with a Bias Voltage Controlled Method and a Compensation Method of Shading", AM-LCD '96/IDW '96, pp. 145–148 is meant, i.e. not the voltage across a row electrode during non-selection when the gate-bias signal is applied to a selection electrode. Instead of being applied to a row electrode, the bias signal may also be applied, for example, to a common connection for a number of capacitances within one row. Where a selection period is referred to in this application, the period is meant which comprises the selection signal and the bias signal for one selection.

These and other aspects of the invention are apparent from and will be elucidated with reference to the embodiments described hereinafter.

BRIEF DESCRIPTION OF THE DRAWING

In the drawings:

FIG. 1 is a diagrammatic cross-section of a part of a display device, while

DESCRIPTION OF THE PREFERRED EMBODIMENTS

Figure 1:
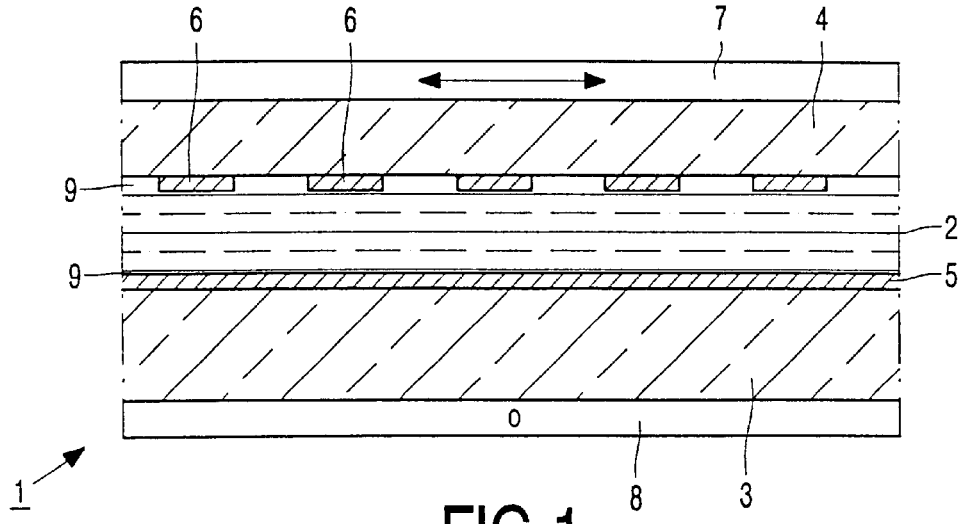

FIG. 1 is a diagrammatic cross-section of a part of a liquid crystalline display device 1, for example having the size of several pixels, comprising a liquid crystal cell with a twisted nematic liquid crystalline material 2 which is present between two substrates 3, 4 of, for example glass, provided with electrodes 5, 6. The device further comprises two polarizers 7, 8 whose directions of polarizations are mutually crossed perpendicularly. The cell further comprises orientation layers 9 which orient the liquid crystalline material on the inner walls of the substrates. In this case, the liquid crystalline material has a positive optical anisotropy and a positive dielectric anisotropy. If the electrodes 5, 6 are energized with an electric voltage, the molecules and hence the directors are directed towards the fields. In the ideal case, all molecules (in the case of full drive) are substantially perpendicular to the two substrates. However, in practice, this situation requires a too high voltage; at the customary voltages, the molecules extend at a small angle to the normal on the substrates 3, 4 so that there is a considerable and also asymmetrical angle dependence.

Figure 2:
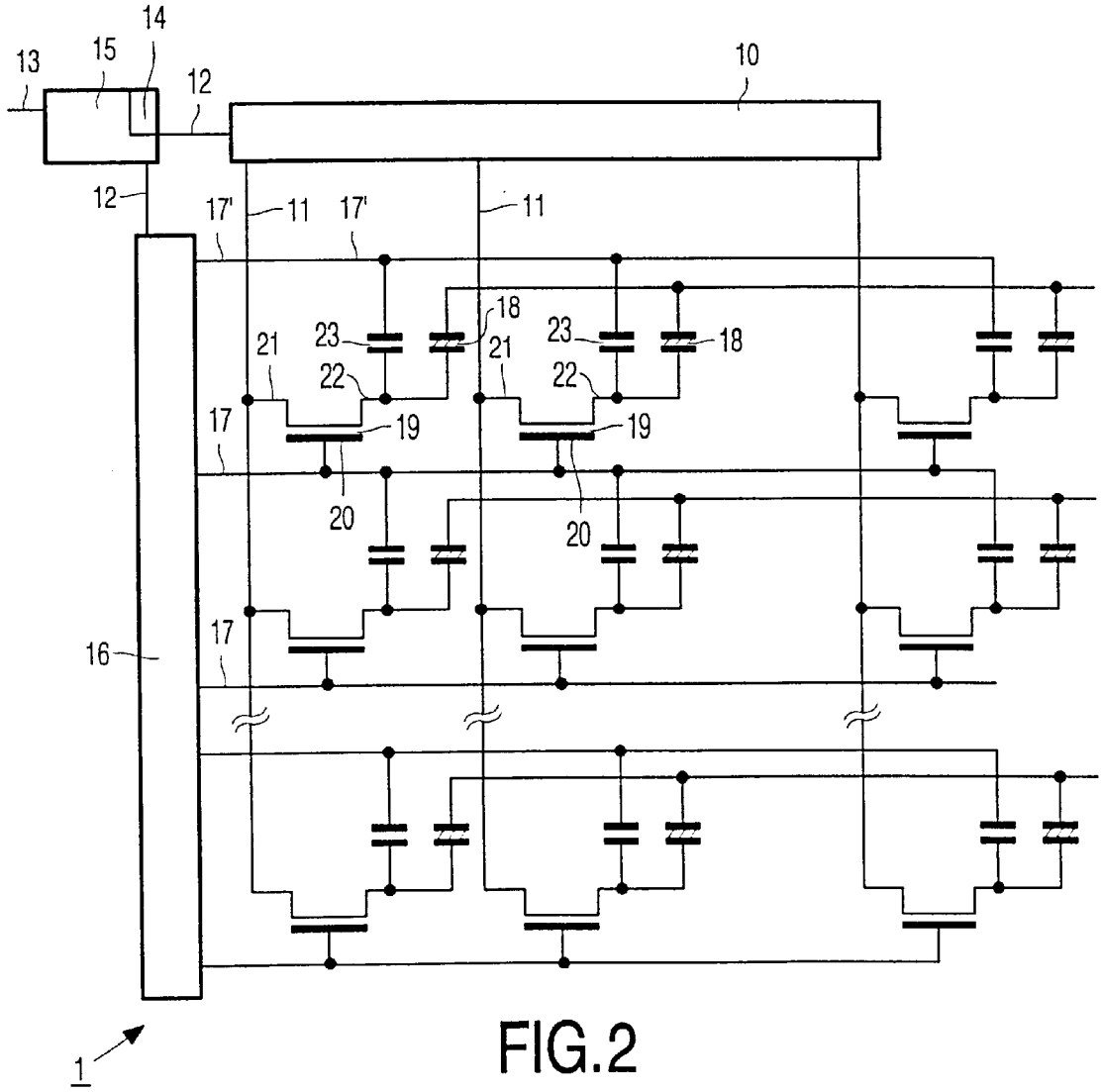
FIG. 2 is an equivalent circuit diagram of a part of a display device according to the invention.

The voltage across the picture electrodes is determined by the drive mode. FIG. 2 diagrammatically shows a picture display device 1 which is controlled by means of active switching elements, in this example thin-film transistors. It comprises a matrix of pixels 18 at the area of crossings of row or selection electrodes 17 and column or data electrodes 11 which are now present on one substrate. The other substrate is provided with one or more counter electrodes. The row electrodes are consecutively selected by means of a row driver 16, while the column electrodes are provided with data via a data register 10. If necessary, incoming data 13 is first processed in a processor 15. Mutual synchronization between the row driver 16 and the data register 10 takes place via drive lines 12.

Drive signals from the row driver 16 select the picture electrodes via thin-film transistors (TFTs) 19 whose gate electrodes 20 are electrically connected to the row electrodes 17 and whose source electrodes 21 are electrically connected to the column electrodes 11. The signal which is present at the column electrode 11 is applied via the TFT to a picture electrode of a pixel 18 coupled to the drain electrode 22. The other picture electrodes are connected, for example, to one (or more) common counter electrode(s).

In this embodiment, the display device of FIG. 2 also includes an auxiliary capacitor 23 at the location of each pixel. In this embodiment, the auxiliary capacitor is connected between the common point of the drain electrode 22 and the pixel in a given row of pixels, on the one hand, and the row electrode of the previous row of pixels, on the other hand; different configurations are alternatively possible, for example an auxiliary capacitor between said common point or one of the subsequent rows of pixels (or a previous row). It is to be noted that these auxiliary capacitors do not occur in all display devices based on TFTs.

To prevent deviations in the picture, the display device of FIG. 2 includes an extra row electrode 17'.

Instead of TFTs, two-pole elements such as MIMs or diodes may be used. Moreover, plasma-channel drive is also possible (PALC displays), while the invention is also applicable to passive display devices.

Figure 3:
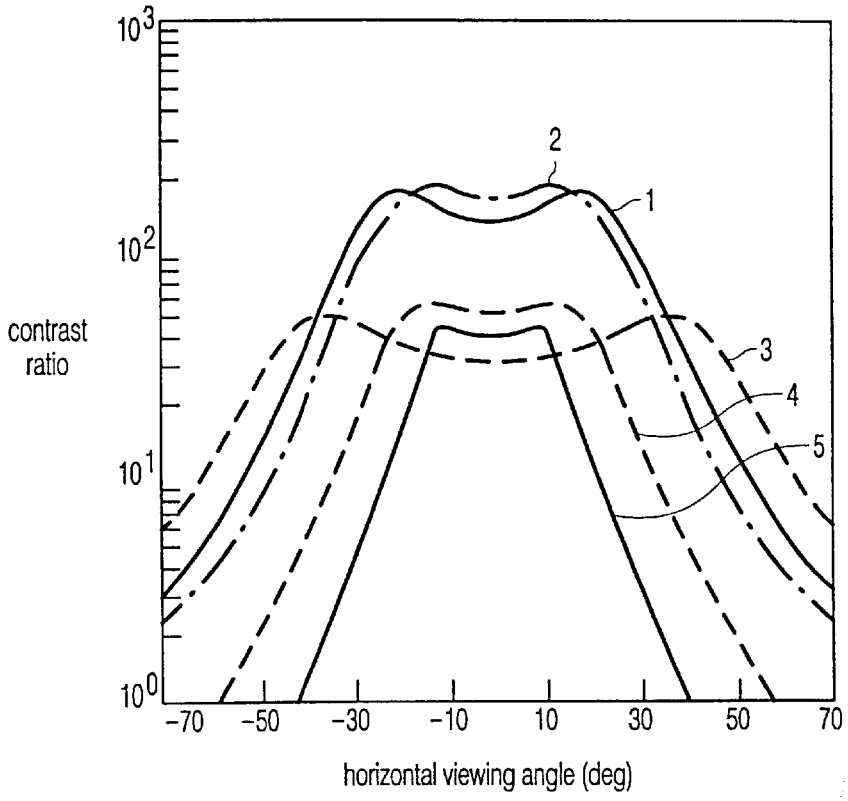
FIGS. 3 and 4 show the angle dependence of the display device for different voltage ranges.

FIG. 3 shows how there is a constriction of the viewing angle when using a voltage range which is offset with respect to the conventional voltage range. This Figure shows how the contrast ratio between the two extreme states changes as a function of the angle between the viewing direction and the normal on the screen.

For the device of FIG. 1, 2, there is an optimal contrast and viewing angle behavior when the voltage across a pixel varies between 2V and 5V (curve 1 in FIG. 3). When the voltage across a pixel varies between 2V and 6V (curve 2 in FIG. 3, dot-and-dash line), the contrast increases but the maximal viewing angle slightly decreases. The reverse situation occurs when the voltage across a pixel varies between 2V and 4V (curve 3 in FIG. 3, broken line). When the voltage across a pixel varies between 3V and 6V, or between 3V and 5V (curves 4 and 5, respectively, in FIG. 3), both the contrast and the maximum viewing angle have decreased, whereas the decrease of the contrast is acceptable for perpendicular view. For a viewer who is sitting right behind the screen, the contrast is sufficient, but a person sitting next to him cannot see the information on the screen. When information is presented to a group of persons, the screen is switched to the situation of curve 1 again (or, for example 3). This is effected via a switching element 14 (FIG. 2) which shifts, for example, the voltage at the counter electrode (in an LCD based on TFTs) or the average voltage or the voltage range of the data or selection signals. Switching may of course also take place between two ranges via a discrete step in the voltage range, but also via a gradual transition.

In this case, switching is represented by way of a switching element 14. On the one hand, this may be a physical switch operated, for example, manually, or, on the other hand, the votlage range may be changed via software control, for example, with embedded software in the processor 15 or through other programming modes.

Figure 4:
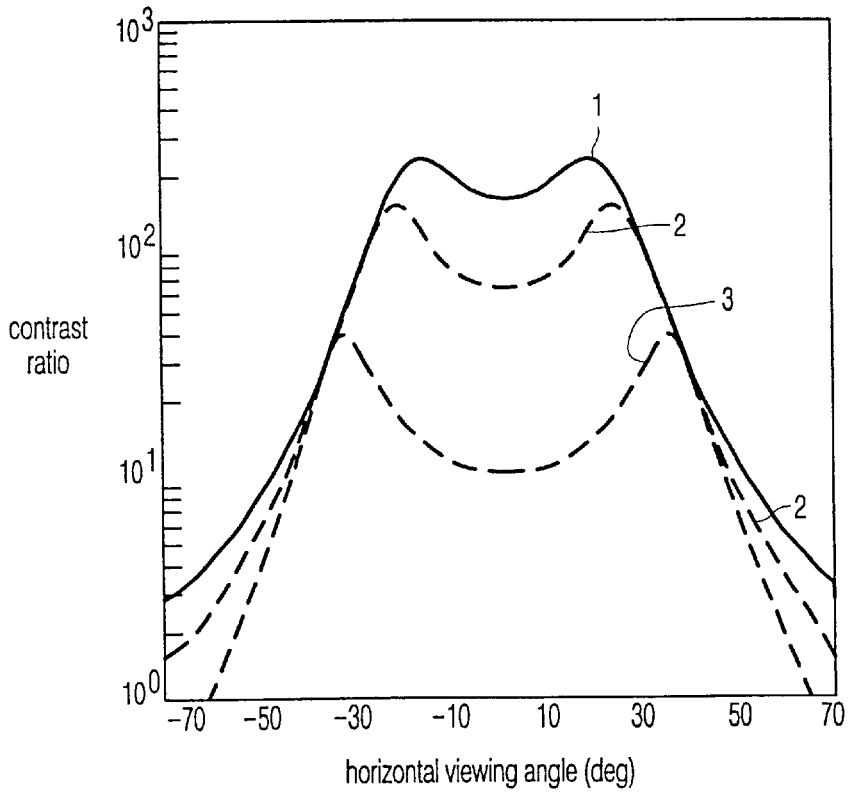

FIG. 4 shows how the angles vary when the average voltage across the pixel is maintained constant, and the gradual decrease of the width of the voltage range (curve 1: 2V–5V, curve 2: 2.5V–4.5V and curve 3: 3V–4V). As regards the constriction of the angle, the effect is much smaller in this case. The greatest effect is generally found when the transmission as a function of the voltage for normal passage of light strongly differs from that for oblique passage of light, such as, for example for the (S)TN effect and the PDLC effect, or the Guest-Host effect, but much less for, for example devices based on IPS (In Plane Switching, picture electrode and counter electrode on one substrate), VAN (Vertically Aligned Nematic), although some effect is also visible in these devices.

The electro-optical effect to be used should minimally have three drive modes, with the viewing angle for each of the three modes varying differently. These three modes are either the white state, the black state for a wide viewing angle and the black state for a narrow viewing angle, or the black state, the white state for a wide viewing angle and the white state for a narrow viewing angle. Examples are liquid crystal effects based on a (surface-stabilized) cholesteric structure.

The voltage range variation (shift, constriction) is obtained either by adapting the voltage across the counter electrode or an auxiliary electrode, or by adapting data voltages (for example, in the case of passive drive or in PALC displays) or column voltages.

What is claimed is:

1. A display device comprising a matrix of pixels, in which each pixel is coupled to a row electrode and a column electrode, control means comprising first drive means for applying a selection signal to the row electrodes and second drive means for applying a data signal to the column electrodes, characterized in that the control means comprises user adjustable means for adjusting different drive modes of the device to set a viewing angle at which a given contrast ratio is observable, said user adjustable means comprising means for adjusting different voltage ranges across a pixel during said different drive modes of the display device.

2. A display device as claimed in claim 1, characterized in that the different voltage ranges have a different width.

3. A display device as claimed in claim 1, characterized in that the different voltage ranges have a different average absolute value.

4. A display device as claimed in claim 1, characterized in that the data signals have an adjustable voltage range.

5. A display device as claimed in claim 1, characterized in that each pixel is coupled to the row or column electrode via a switching element.

6. A display device as claimed in claim 5, characterized in that each pixel is coupled to the row or column electrodes via a switching element and is provided with at least one counter electrode, and the control means comprise means for applying different voltages for the different voltage ranges to the counter electrode.

7. A display device as claimed in claim 5, characterized in that the picture electrode is capacitively coupled to a further electrode, and the display device comprises drive means for applying a selection signal to the row electrodes during a selection period and a bias signal to the row electrode or the further electrode, and the control means comprise means for applying different voltages for the different voltage ranges to the row electrode or the further electrode.

8. A display device as claimed in claim 1, characterized in that plasma channels function as row electrodes.

9. A display device as claimed in claim 1, characterized in that said user adjustable means affects picture contrast for a part of a picture to be displayed.

* * * * *